US009875731B2

(12) United States Patent
Shigenaga

(10) Patent No.: US 9,875,731 B2
(45) Date of Patent: Jan. 23, 2018

(54) MUSICAL INSTRUMENT CARRIER

(71) Applicant: Yamaha Corporation, Hamamatsu-shi, Shizuoka-ken (JP)

(72) Inventor: Fumihiro Shigenaga, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 15/270,792

(22) Filed: Sep. 20, 2016

(65) Prior Publication Data

US 2017/0092244 A1 Mar. 30, 2017

(30) Foreign Application Priority Data

Sep. 25, 2015 (JP) ..... 2015-188368

(51) Int. Cl.
*G10G 5/00* (2006.01)
*A45F 3/10* (2006.01)

(52) U.S. Cl.
CPC ..... *G10G 5/005* (2013.01); *A45F 3/10* (2013.01)

(58) Field of Classification Search
CPC ..... G10G 5/005
See application file for complete search history.

(56) References Cited

U.S. PATENT DOCUMENTS 3,106,123 A * 10/1963 Johannsen ..... G10G 5/005 224/265
6,028,257 A * 2/2000 May ..... G10D 13/00 248/443
6,323,407 B1 * 11/2001 May ..... G10D 13/00 248/443
6,329,583 B1 * 12/2001 May ..... G10G 5/005 248/443
6,765,140 B2 * 7/2004 Crouch ..... G10G 5/005 84/421
7,812,235 B2 * 10/2010 May ..... G10D 13/029 84/411 P
8,598,443 B2 * 12/2013 May ..... G10D 13/00 84/421
8,646,666 B2 * 2/2014 May ..... G10G 5/005 224/201
8,658,876 B2 * 2/2014 Momose ..... G10G 5/005 84/421
2004/0194608 A1 * 10/2004 May ..... G10G 5/005 84/421
2008/0202316 A1 * 8/2008 Hsieh ..... G10G 5/005 84/421
2008/0264236 A1 * 10/2008 Miyajima ..... G10G 5/005 84/421
2010/0154617 A1 * 6/2010 May ..... G10G 5/005 84/421
2013/0233148 A1 * 9/2013 May ..... G10G 5/005 84/421

(Continued)

FOREIGN PATENT DOCUMENTS

JP 2003-005745 A 1/2003

*Primary Examiner* — Robert W Horn
(74) *Attorney, Agent, or Firm* — Morrison & Foerster LLP

(57) ABSTRACT

A musical instrument carrier includes a rod position regulating member that is attached to a rod in order to set the attachment position of a musical instrument, and can selectively be put in either a movable state with respect to the rod or a fixed state with respect to the rod in order to set the attachment position of a musical instrument.

11 Claims, 11 Drawing Sheets

(56) References Cited

U.S. PATENT DOCUMENTS

| | | | | |
|---|---|---|---|---|
| 2015/0129624 | A1* | 5/2015 | Sumner | G10G 5/005 224/265 |
| 2016/0217775 | A1* | 7/2016 | May | G10D 13/026 |
| 2016/0225355 | A1* | 8/2016 | Shigenaga | G10G 5/005 |
| 2017/0092243 | A1* | 3/2017 | Tadano | A45F 3/10 |
| 2017/0092244 | A1* | 3/2017 | Shigenaga | A45F 3/10 |

* cited by examiner

MUSICAL INSTRUMENT CARRIER

BACKGROUND OF THE INVENTION

Field of the Invention

The present invention relates to a musical instrument carrier that supports a musical instrument at the front of a performer.

Priority is claimed on Japanese Patent Application No. 2015-188368, filed Sep. 25, 2015, the content of which is incorporated herein by reference.

Description of Related Art

A musical instrument carrier that supports a musical instrument such as a marching drum in front of a performer is conventionally used in parades, shows and the like.

As disclosed in Japanese Unexamined Patent Application No. 2003-5745 (JP-A 2003-5754), this kind of musical instrument carrier has an abdomen rest member that is abutted on the abdominal area of the performer, a pair of rod clamps that are fixed to the front side of the abdomen rest member, and a pair of rods.

The rods are fixed to the inside of the rod clamps by the fastening of screws. Also, by fastening the screws, the heights of the rods and their positions in the rotation direction can be regulated.

In the case of supporting a musical instrument using the aforementioned musical instrument carrier, a rod mounting mechanism is mounted on the musical instrument, and by respectively inserting the rods in the pair of rod insertion holes provided in the rod mounting mechanism, the musical instrument is supported.

When supporting a musical instrument using the musical instrument carrier, the following process is performed.

First, the screws are loosened to put the rods in a movable state with respect to the respective rod clamps. Then, the height and/or position in the rotation direction (in other words, the opening degree) of the pair of rods are/is adjusted so as to be insertable in the rod insertion holes provided in the rod mounting mechanism. Subsequently, by tightening the screws, the positions of the rods with respect to the rod clamps are regulated.

Supporting a musical instrument using the musical instrument carrier in this way has been extremely cumbersome since it is necessary to perform the above process each time prior to playing the musical instrument.

SUMMARY OF THE INVENTION

The present invention was achieved in view of the aforementioned circumstances, and has as its object to provide a musical instrument carrier that can easily reproduce the adjusted height and/or position in the rotation direction of the rods.

The musical instrument carrier of the present invention has a carrier main body portion; a rod that supports a musical instrument at the front surface of the carrier main body portion; a rod clamp that is attached to the front surface of the carrier main body portion and that selectively holds the rod in either one of a movable state in the lengthwise direction of the rod or a fixed state in the lengthwise direction; and a rod position regulating member that is attached to the rod and that selectively engages with the rod in either one of a movable state in the lengthwise direction or a fixed state.

By the musical instrument carrier of one aspect of the present invention including the rod position regulating member, after positioning of the rod for supporting a musical instrument (specifically, after determining the height of the rod and/or the position of the rod in the rotation direction), it is possible to affix the rod position regulating member to the positioned rod.

Thereby, for example, in the state of the rod position regulating member being affixed to the rod, even if the height of the rod and/or the position of the rod in the rotation direction are/is altered from the predetermined position that has been determined, it is possible to easily reproduce the positioned height of the rod and/or the predetermined position of the rod in the rotation direction.

In the musical instrument carrier described above, the carrier main body portion may have an abdomen rest member that is abutted on the abdomen of a performer, and the rod clamp may be affixed to the front surface side of the abdomen rest member.

Also, the rod clamp may have a first fastening member that selectively holds the rod in either one of the movable state or the fixed state, and this first fastening member, when loosened, may hold the rod in the movable state, while the first fastening member, when tightened, may hold the rod in the fixed state.

Moreover, the rod position regulating member may position the rod by being abutted on the rod clamp in the state of being affixed to the rod.

In this way, by affixing the rod position regulating member to the rod so as to make contact with the rod clamp, since it is possible to make the position of the rod clamp affixed to the abdomen rest member serve as a reference position in the height direction, it is possible to easily reproduce the positioned height of the rod.

In the musical instrument carrier described above, the rod position regulating member may be detachable from the rod.

Also, the rod position regulating member may have a second fastening member, and the second fastening member, when tightened, may engage with the rod in a fixed state, while the second fastening member, when loosened, may engage in a movable manner with the rod.

In this way, by the rod position regulating member having the second fastening member that is detachable from the rod, it is possible to easily attach/detach the rod position regulating member to/from the rod.

The musical instrument carrier described above may have a protruding portion provided in either one of a displacement member that is displaced relative to rotation of the rod when the rod is rotated about the lengthwise direction, and the rod position regulating member.

Also, the protruding portion may regulate rotation of the rod by abutting on the other member in which the protruding portion is not provided among the displacement member and the rod position regulating member during rotation of the rod.

In this way, by causing the protruding portion to abut on the other member in which the protruding portion is not provided among the displacement member and the rod position regulating member during rotation of the rod, since it is possible to make the abutted position the positioned position of the rod in the rotation direction, it is possible to easily reproduce the position of the rod in the rotation direction at the positioned position of the rod in the rotation direction.

In the musical instrument carrier described above, the rod position regulating member may be rotatable in a range of not abutting on the displacement member during rotation of the rod.

By adopting such a constitution, when the musical instrument carrier is not in use, by rotating a rod on which the rod position regulating member is affixed to the center side of the abdomen rest member, it is possible to put the rod in a closed state. Thereby, it is possible to reduce the space required for storage of the musical instrument carrier.

Also, after the rod position regulating member is stored in a state of being affixed to the rod, upon using the musical instrument carrier, it is possible to easily make the position of the rod in the rotation direction the position of the rod in the rotation direction after positioning.

In the musical instrument carrier described above, the displacement member may be the abdomen rest member included in the carrier main body portion or the rod clamp.

In this way, by using the abdomen rest member or the rod clamp as the displacement member it is possible to sufficiently make the rod position regulating member function.

According to the present invention, it is possible to easily reproduce the height and/or the position in the rotation direction of the rod after adjustment.

DETAILED DESCRIPTION OF THE INVENTION

Figure 1:
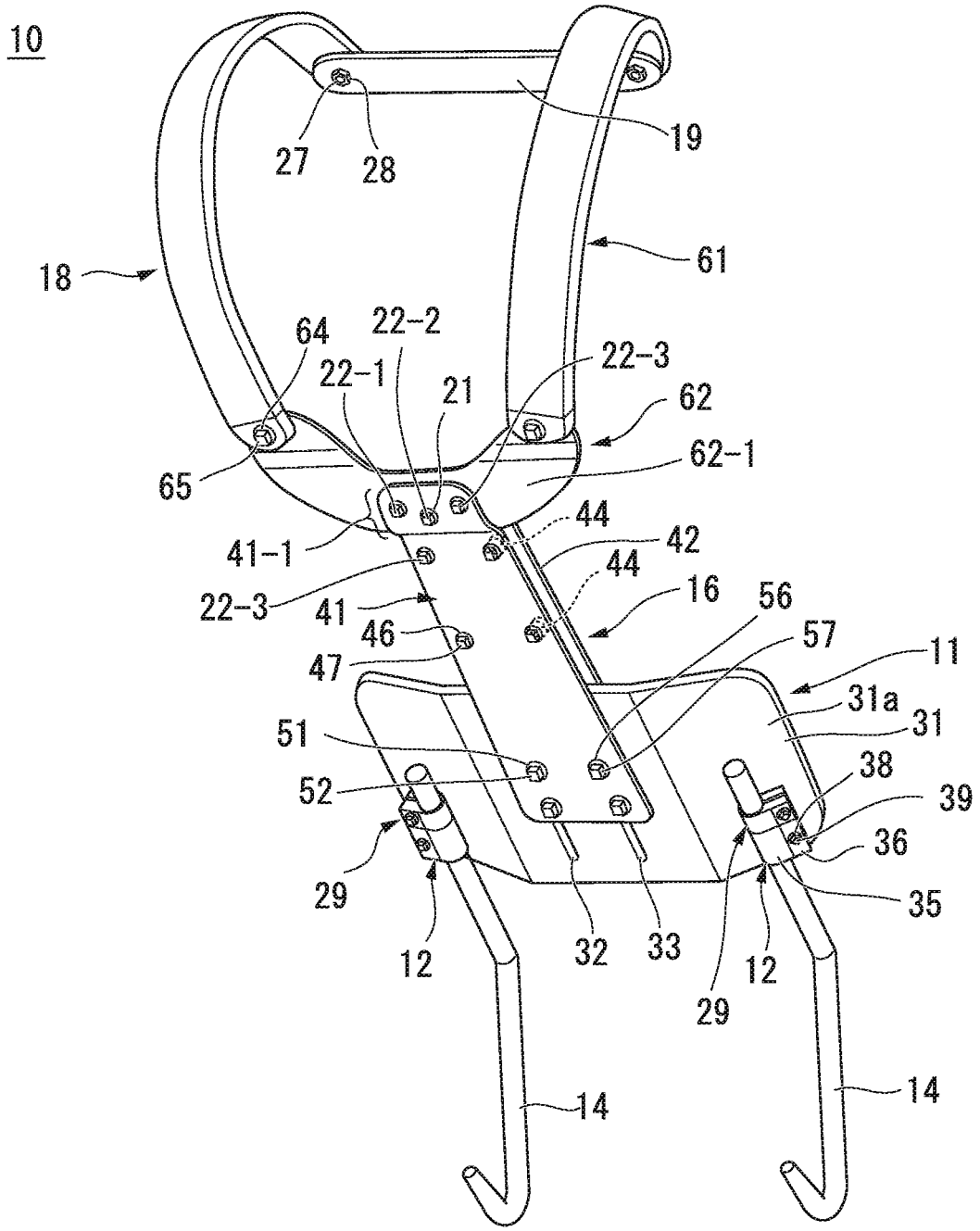
FIG. 1 is a perspective view showing the musical instrument carrier according to one embodiment of the present invention.

Hereinbelow, an embodiment applying the present invention will be described in detail referring to the drawings. Note that the drawings used in the following description are for describing the constitution of the embodiment of the present invention, and the size, thickness, and dimensions of each part that is illustrated may differ from the dimensional relation of the actual musical instrument carrier.

Note that in the following embodiment, directions such as up and down, unless otherwise specified, indicate directions in reference to a state of the performer standing while wearing the musical instrument carrier.

Embodiment

Figure 2:
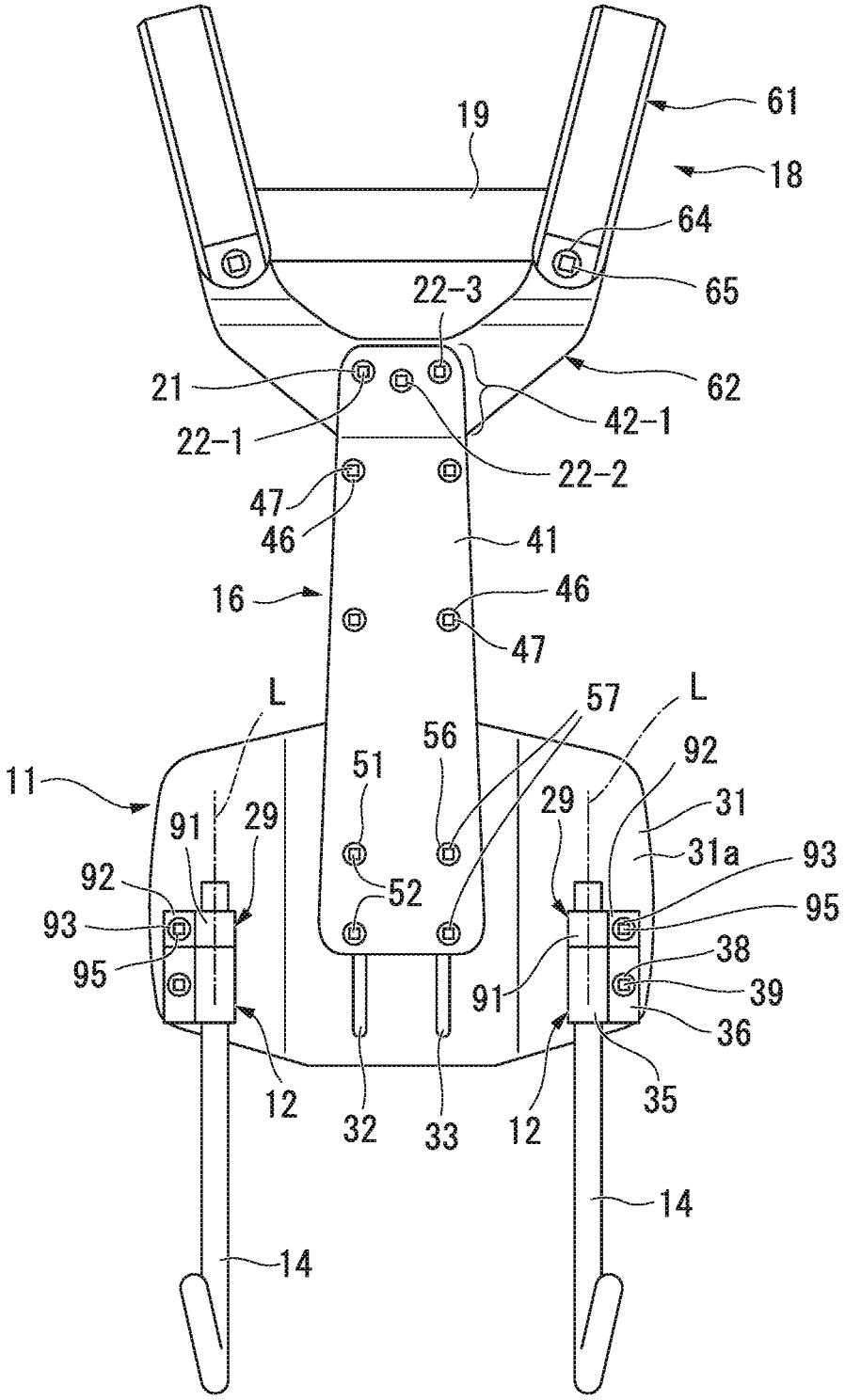
FIG. 2 is a front view showing the musical instrument carrier of the present embodiment.
Figure 3:
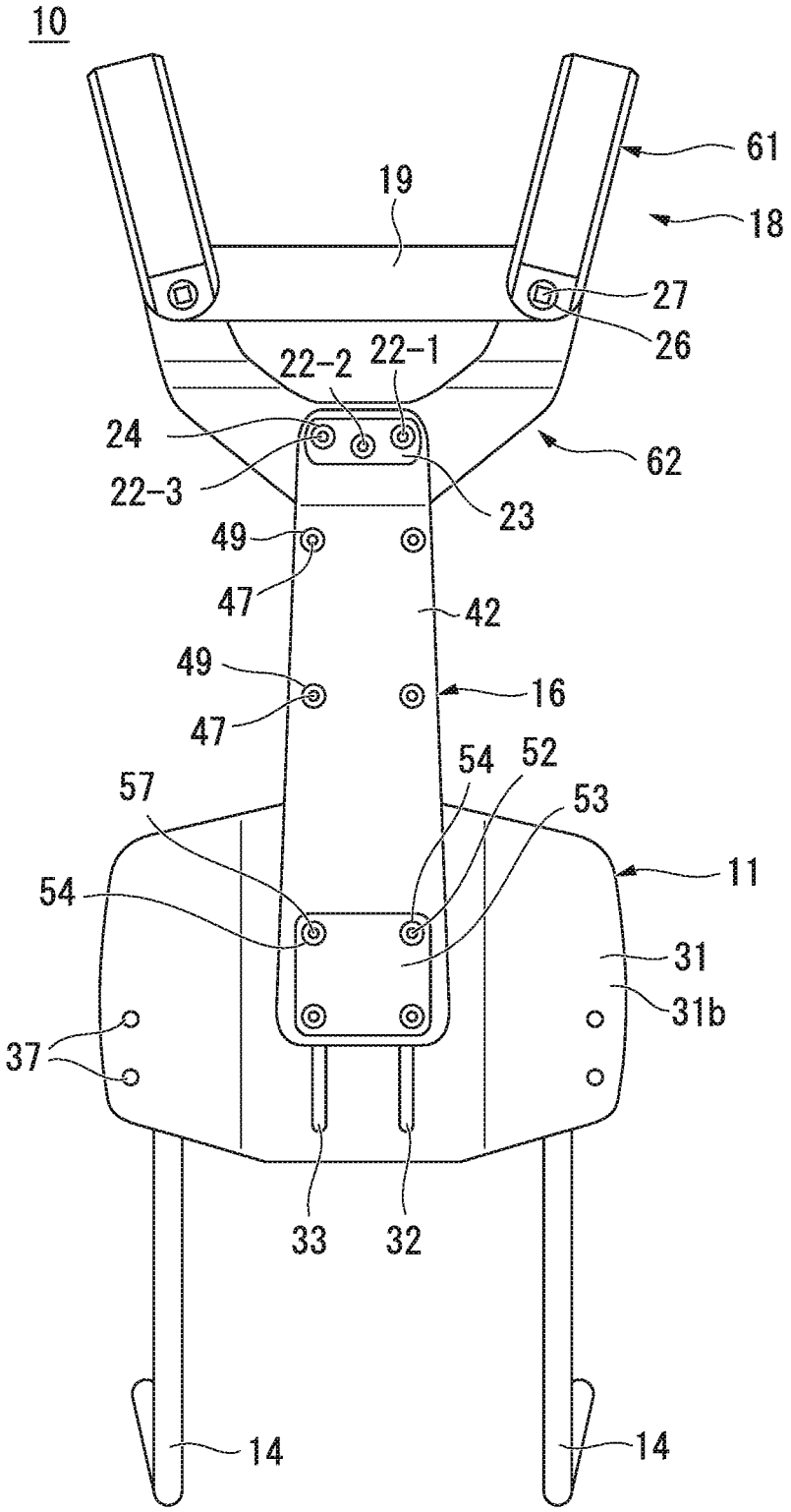
FIG. 3 is a back view showing the musical instrument carrier of the present embodiment.
Figure 4:
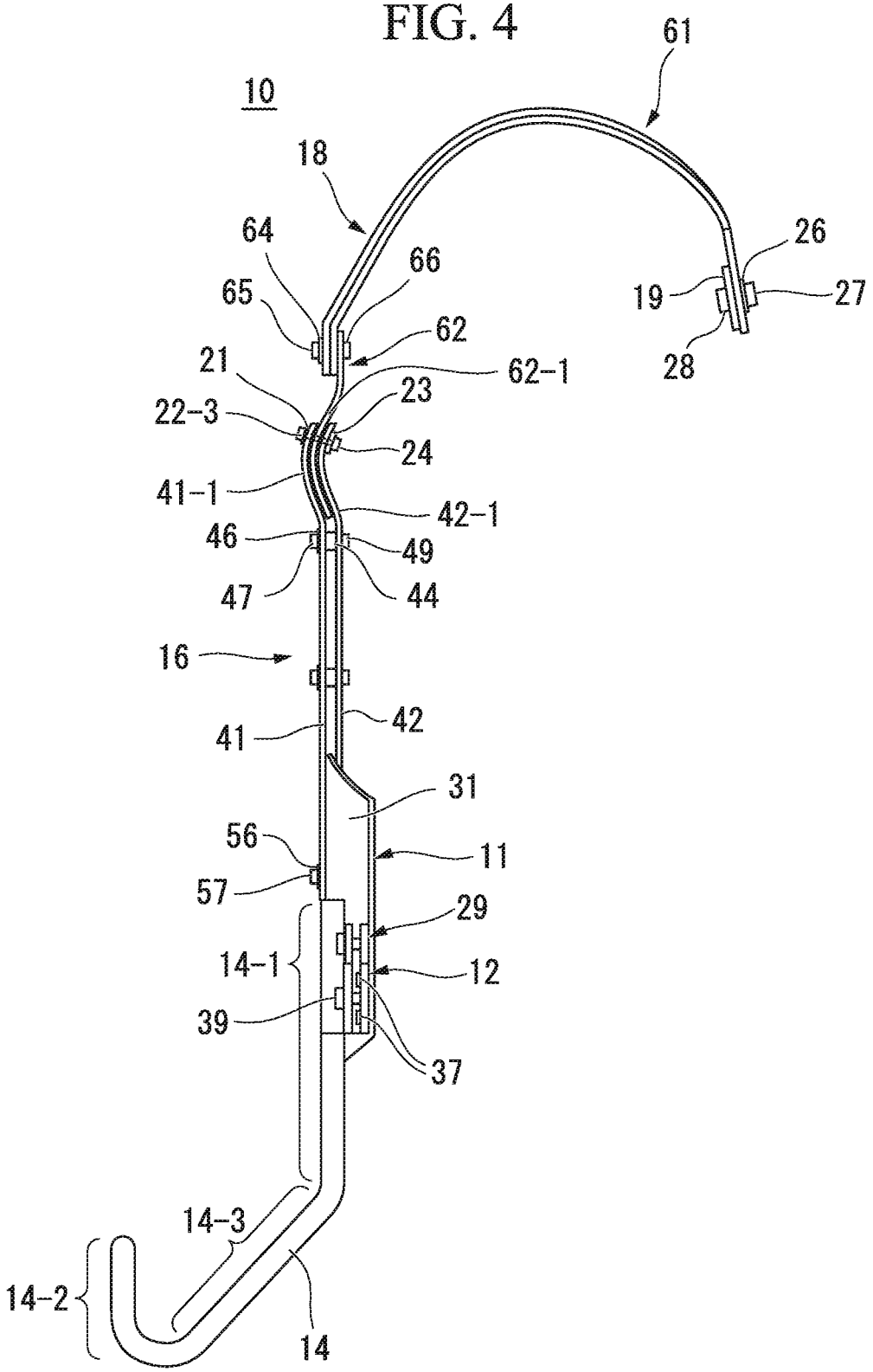
FIG. 4 is a side view showing the musical instrument carrier of the present embodiment.

FIG. 1 is a perspective view of the musical instrument carrier according to the embodiment of the present invention. FIG. 2 is a front view of the musical instrument carrier shown in FIG. 1. FIG. 3 is a back view of the musical instrument carrier shown in FIG. 1. FIG. 4 is a side view of the musical instrument carrier shown in FIG. 2. In FIG. 2 to FIG. 4, the same reference numerals are given to those constituent portions that are the same as the corresponding portions of the musical instrument carrier 10 shown in FIG. 1.

Referring to FIG. 1 to FIG. 4, the musical instrument carrier 10 of the present embodiment has an abdomen rest member 11, a pair of rod clamps 12, a pair of rods 14, a coupling member 16, a shoulder rest member 18, a back rest member 19, and a rod position regulating member 29. These members are assembled by a plurality of washer plates 21 and 26, bolts 22-1, 22-2, and 22-3, a backing plate 23, a plurality of nut plates 24 and 28, and a plurality of bolts 27 and the like.

That is, in the musical instrument carrier 10, the carrier main body portion is constituted by the abdomen rest member 11, the coupling member 16, the shoulder rest member 18, the back rest member 19, and the parts for assembling them. A pair of rods 14 are attached by a pair of rod clamps 12 to the carrier main body portion.

The abdomen rest member 11 has an abdomen rest member main body 31 and slide grooves 32 and 33. The abdomen rest member main body 31 is a plate-like member that is formed with the side portions thereof curved so as to match the shape of the abdomen of the performer. A back surface 31*b* of the abdomen rest member main body 31 is abutted on the abdomen of the performer.

The abdomen rest member 11 is preferably constituted by a lightweight material (for example, aluminum) from the standpoint of easing the burden on the performer.

The slide grooves 32 and 33 are provided in parallel at the center portion of the abdomen rest member main body 31, and penetrate the abdomen rest member main body 31.

The slide grooves 32 and 33 are arranged so that they may extend in the extension direction of the coupling member 16 (in other words, the height direction (vertical direction) in the state of the performer wearing the musical instrument carrier 10).

The widths of the slide grooves 32 and 33 are respectively set to a size through which the respective shafts of bolts 52 and 57 can pass.

The pair of rod clamps 12 are arranged at the lower portion of the front surface 31*a* on both sides of the abdomen rest member main body 31.

The rod clamp 12 has a rod housing portion 35, a protruding portion 36, a washer plate 38, and a bolt 39.

The rod housing portion 35 has a rod insertion hole (penetration hole) in which the rod 14 can be inserted. The rod insertion hole is a hole that penetrates the rod housing portion 35.

The protruding portion 36 is constituted by two plate portions oppositely disposed with a gap interposed therebetween. Of the two plate portions, the plate portion in contact with the front surface 31*a* side of the abdomen rest member main body 31 is affixed to the abdomen rest member main body 31 with two screws 37 from the back surface 31*b* side of the abdomen rest member main body 31. The protruding portion 36 is integrally constituted with the rod housing portion 35.

A bolt 39 is fastened so as to reach the two plate portions constituting the protruding portion 36 via the washer plate 38. Loosening the bolt 39 widens the gap between the two plate portions, whereby since the rod insertion hole also widens, a state arises of the rod 14 being able to move in the extension direction of the rod insertion hole within the rod clamp 12.

On the other hand, tightening the bolt 39 narrows the gap between the two plate portions, whereby since the diameter of the rod insertion hole also narrows, the position of the rod 14 is restricted (in other words, the opening degree and height of the rod 14 are fixed).

Note that in the present invention, "height of the rod 14" refers to the distance from the attachment position of the rod at the abdomen rest member of the musical instrument carrier 10 to the bent-back position at the one end side of the rod 14 (that is, the position that supports a musical instrument).

The rod 14 is constituted in a J shape by bending back a portion of one rod-like member, and has a short straight bar portion 14-2, a long straight bar portion 14-1, and a sloping coupling portion 14-3 that slopes slightly downward from the short straight bar portion to the long straight bar portion to couple them.

The rod 14 has a function of supporting a musical instrument with the short straight bar portion 14-2 on one end side, and coupling to the abdomen rest member 11 by the long straight bar portion 14-1 at the other end side. The rod 14 is fixed by the bolt 39 being fastened in the state of the long straight bar portion 14-1 at the other end portion side of the rod 14 being housed in the rod insertion hole of the rod clamp 12, whereby the opening degree between the short straight bar portions 14-2 of the pair of rods 14 and height of the rods 14 are regulated.

For example, in the case of using the musical instrument carrier 10 to support a drum, the short straight rod portions 14-2 of the rods 14 are respectively inserted in the two rod insertion holes provided in the carrier coupling member (not illustrated) mounted on the drum. For this reason, in the case of supporting a drum using the musical instrument carrier 10, it is necessary to adjust the opening degree and position of the rods 14 so that the rods 14 can be inserted in the two rod insertion holes of the carrier coupling member mounted on the drum.

Note that in FIG. 1, as one example of the rod 14 a rod formed in a J shape is given as an example, but the shape of the rod 14 can be suitably selected in accordance with the musical instrument to be supported, and is not limited to the shape shown in FIG. 1.

Figure 5:
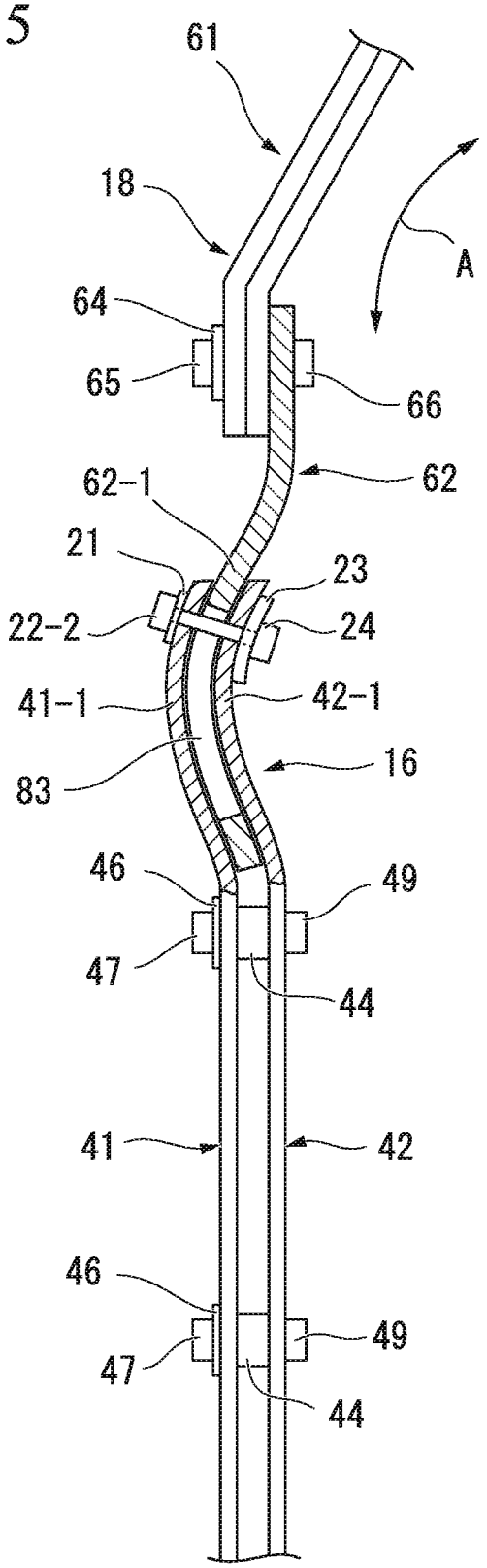
FIG. 5 is a partial magnified side view showing in detail the musical instrument carrier of the present embodiment.

FIG. 5 is a side view that is an enlargement of a portion of the musical instrument carrier shown in FIG. 4. "A" shown in FIG. 5 denotes the moving direction of the shoulder rest member main body 61 when the slide portion 62 slides (hereinbelow "A direction"). In FIG. 5, the same reference numerals are given to those constituent portions that are the same as the corresponding portions of the musical instrument carrier 10 shown in FIG. 1 to FIG. 3.

Note that in FIG. 5, for the sake of convenience of description, a pair of first curved portions 41-1 and 42-1 and a second curved portion 62-1 are illustrated in cross section.

The coupling member 16 has a pair of plate members 41 and 42, a plurality of spacers 44, a plurality of washer plates 46, 51, and 56, a plurality of bolts 47, 52, and 57, a plurality of nut plates 49 and 54, and a backing plate 53.

The plate member 41 is a flat plate-shaped member that extends between the abdomen rest member 11 and the shoulder rest member 18, and is shaped such that the width thereof narrows as the distance increases from the abdomen rest member 11. The plate member 41 has a first curved portion 41-1 that constitutes the upper end portion positioned on the shoulder rest member 18 side.

The first curved portion 41-1 is a member that is formed by curving a portion on the upper end portion side of the plate member 41. The front surface and back surface of the first curved portion 41-1 are made to be flat surfaces. The shape of the first curved portion 41-1, in the state of the performer wearing the musical instrument carrier 10, projects out in a direction heading away from the chest of the performer, with a concavity formed on the performer's side.

Holes (not illustrated) that a plurality of the bolts 52 and 57 penetrate are provided at the lower end portion side of the plate member 41 so that the positions of the holes agree with at least a portion of the slide grooves 32 and 33, and the plate member 41 is arranged to come into contact with the center part of the front surface 31*a* of the abdomen rest portion main body 31. The plate member 41 extends in the vertical direction, with a portion of the plate member 41 projecting upward of the abdomen rest member 11.

The plate member 42 is a member that is constituted similarly to the aforementioned plate member 41, and has a first curved portion 42-1 by curving a portion on the upper end portion side thereof. The plate member 42 is arranged on the back surface side of the abdomen rest member 11, opposing the plate member 41 so that the first curved portion 42-1 faces the first curved portion 41-1.

An example material of the plate members 41 and 42 includes aluminum, which is a lightweight metal.

A plurality of spacers 44 are arranged between the opposing surfaces of the plate members 41 and 42, which project out from the abdomen rest member 11. The plurality of spacers 44 each have a penetration hole allowing the insertion of a bolt 47. The shape of the plurality of spacers 44 can for example be made cylindrical.

The plurality of spacers 44 have a function of maintaining the spacing between the opposing surfaces of the plate members 41 and 42 at a predetermined spacing by the height thereof.

The length of the plurality of spacers 44 should be set so as to be a slightly greater value than, for example, the thickness of the abdomen rest member main body 31 and the thickness of the slide member 62 described below that constitutes the shoulder rest member 18.

Thereby, a gap that enables sliding of the abdomen rest member 11 arranged between the lower end portions of the plate members 41 and 42 and a gap that enables sliding of the second curved portion 62-1 of the slide member 62 arranged between the first curved portions 41-1 and 42-1 are formed.

Each of the plurality of bolts 47 passes through the washer plate 46 and the spacer 44, and is screwed into a nut plate 49 arranged at the back surface of the plate member 42. Thereby, the plate members 41 and 42 are fixed.

Note that in the present embodiment, as one example, the case of using four each of the spacer 44, the washer plate 46, the bolt 47, and the nut plate 49 was given as an example, but the numbers of the spacers 44, the washer plates 46, the bolts 47, and the nut plates 49 can be suitably selected and are not limited to four.

The bolts 52 penetrate the backing plate 53 that is arranged on the back surface of the slide groove 32 and the plate member 42.

The bolts 57 penetrate the backing plate 53 that is arranged on the back surface of the slide groove 33 and the plate member 42. Each of the bolts 52 and 57 is screwed into the nut plate 54.

By passing the respective shaft portions of two bolts (two of the bolts 52 or two of the bolts 57) in each of the parallel slide grooves 32 and 33 at mutually differing positions, the coupling member 16 can be made to slide so as to follow the extension direction of the slide grooves 32 and 33 without the coupling member 16 tilting with respect to the extension direction of the slide grooves 32 and 33.

Thereby, it is possible to easily adjust the height of the abdomen rest member 11 so as to abut the abdomen of the performer wearing the musical instrument carrier 10.

The abdomen rest member main body 31 is disposed between the plate members 41 and 42, and by tightening the bolts 52 and 57, the position thereof is maintained. On the other hand, by loosening the bolts 52 and 57, the positional relation of the abdomen rest member main body 31 with the plate members 41 and 42 is adjusted by mutually shifting the position thereof without the abdomen rest member main body 31 being separated from the plate members 41 and 42.

That is, by sliding the abdomen rest member main body 31 in the extension direction of the slide grooves 32 and 33 with respect to the plate members 41 and 42, it is possible to easily adjust the position of the abdomen rest member main body 31 with respect to the plate members 41 and 42.

The positional relations of the abdomen rest member main body 31 and the plate members 41 and 42 are maintained by sandwiching them so that the front surface 31*a* of the abdomen rest member main body 31 and the back surface of the plate member 41 make surface contact, and the back surface 31*b* of the abdomen rest member main body 31 and the front surface of the plate member 42 make surface contact. Accordingly, compared to the case of the abdomen rest member main body 31 being held by only one surface thereof being brought into surface contact with a plate member, it is possible to increase the resistance between the abdomen rest member main body 31 and the plate members 41 and 42. Thereby, the musical instrument carrier is less susceptible to shifting from the body of the performer during a performance.

The shoulder rest member 18 has a pair of shoulder rest member main bodies 61, a slide member 62, a plurality of washer plates 64, a plurality of bolts 65, and a plurality of nuts 66.

The shoulder rest member main bodies 61 are for example formed by curving a plate material. The shoulder rest member main bodies 61 curve over a longer range than the first curved portions 41-1 and 42-1. From the standpoint of lightening the musical instrument carrier 10, it is possible to use for example aluminum as the material of the shoulder rest member main bodies 61.

Figure 6:
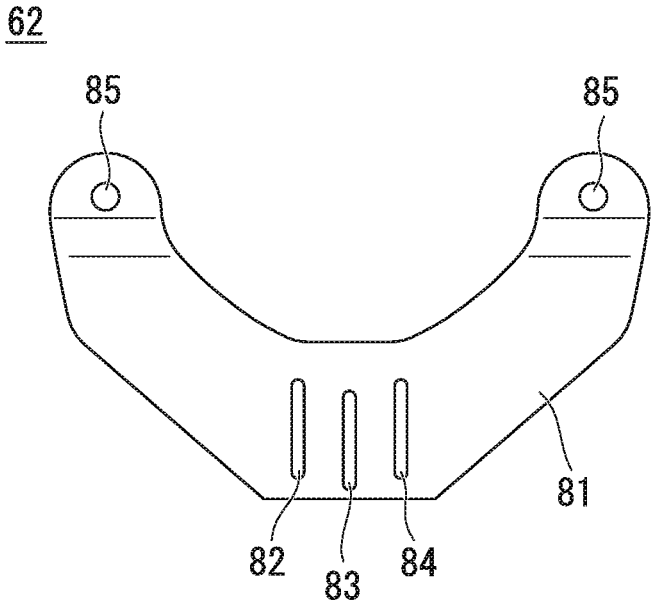
FIG. 6 is a front view showing the slide member shown in FIG. 2.

FIG. 6 is a front view of the slide member shown in FIG. 2. In FIG. 6, the same reference numerals are given to those constituent portions that are the same as the corresponding structures shown in FIG. 1 to FIG. 5.

The slide member 62 has a slide member main body 81 that is a plate-shaped member formed in a U shape, slide grooves 82 to 84, and bolt holes 85.

As shown in FIG. 5, as a portion of the shoulder rest member 18, at the lower portion of the slide member 62 a second curved portion 62-1 is formed having a shape corresponding to the curved shapes of the first curved portions 41-1 and 42-1.

The second curved portion 62-1 is the shape of a portion of a hollow cylinder that is severed along the axis line, with a convex shape toward the front surface side of the musical instrument carrier. The upper portion of the slide member 62 conversely is convex-shaped toward the back surface side of the musical instrument carrier. The curved portion 62-1 of the slide member 62 is capable of sliding in the vertical direction within the curved space formed between the pair of first curved portions 41-1 and 42-1. The front surface and back surface of the curved portion 62-1 of the slide member 62 are shaped to come in contact with the respective facing surfaces of the pair of first curved portions 41-1 and 42-1.

The second curved portion 62-1 is inserted in the gap formed between the pair of first curved portions 41-1 and 42-1. The second curved portion 62-1 slides while being guided along the circular arcs of the curved surfaces of the pair of first curved portions 41-1 and 42-1.

From the standpoint of weight reduction of the musical instrument carrier 10, it is possible to use, for example, aluminum as the material of the slide member main body 81.

The three slide grooves 82 to 84 are provided so as to pass through the center portion of the second curved portion 62-1. The slide grooves 82 to 84 are grooves that extend parallel to one another in the curved direction (vertical direction) of the second curved portion 62-1.

The groove width of each of the slide grooves 82 to 84 is set to a size in which the shaft portion of each of the bolts 22-1 to 22-3 can pass, yet the head portion of each of the bolts 22-1 to 22-3 and the washer plates 21 cannot pass.

The bolt hole 85 is provided at both end portions of the slide member main body 81 that is formed in a U shape. Each bolt hole 85 is provided so as to penetrate the slide member main body 81. The bolt 65 is screwed into the bolt hole 85.

The bolt 65, via the washer plate 64, penetrates the portion at which one end portion of the shoulder rest member main body 61 and the front surface side of the bolt hole 85 of the slide member 62 overlap. The bolt 65 is screwed into the nut 66 that is disposed on the back surface side of the slide member 62. Thereby, both ends of the slide member 62 and the pair of shoulder rest member main bodies 61 are respectively coupled.

The shaft portion of the bolt 22-1 is inserted in the slide groove 82 and screwed into the nut plate 24 so as to sandwich the pair of first curved portions 41-1 and 42-1 and the backing plate 23 by the washer plate 21 and the nut plate 24. The diameter of the shaft portion of the bolt 22-1 is constituted so as to be narrower than the width of the slide groove 82.

The shaft portions of the bolts 22-2 and 22-3 are respectively inserted in the slide grooves 83 and 84 and screwed into the nut plates 24 similarly to the bolt 22-1.

In this way, by coupling the pair of first curved portions 41-1 and 42-1 and the second curved portion 62-1, which are constituted by curving a plate material, using the bolts 22-1, 22-2, and 22-3, the washer plate 21, and the nut plate 24, it is possible to couple the coupling member 16 and the shoulder rest member 18 with a smaller bulge than the bulge formed by fastening with a screw the fastening rod holder to the conventional support rod (refer to JP-A 2003-5745).

Thereby, it is possible to improve the appearance of the musical instrument carrier 10, and possible to suppress damage to a costume in the case of a performer wearing the musical instrument carrier 10 under a costume.

The slide grooves 82 to 84 are provided in the second curved portion 62-1 arranged between the pair of pair of first curved portions 41-1 and 42-1. The shaft portions of the bolts 22-1, 22-2, and 22-3 are respectively disposed in these slide grooves 82 to 84 and screwed into one nut plate 24.

With this structure, when the bolts 22-1, 22-2, and 22-3 have been loosened, it is possible to slide the second curved portion 62-1 in a circular arc in the extension direction of the slide grooves 82 to 84 (the A direction in FIG. 5) in accordance with the physique of the performer wearing the musical instrument carrier 10.

Thereby, it is possible to easily adjust the angle and top-point position of the shoulder rest member 18 along the circular arc of the large curvature of the curved portions, in conformance with the physique of the performer wearing the musical instrument carrier 10. After this adjustment, by tightening the bolts 22-1, 22-2, and 22-3, since it is possible to keep the curved surfaces with large curvatures of the curved portions in the state of contact, it is possible to inhibit shifting of the musical instrument carrier 10 from the body of the performer during a performance.

Adjustment of the angle and position of the shoulder rest member 18 with respect to the abdomen rest member 11 in this way is performed by sliding the engagement position of the second curved portion 62-1 of the slide member 62 with respect to the first curved portions 41-1 and 42-1 of the coupling member 16. The first curved portions 41-1 and 42-1 are formed by curving the coupling member 16. The second curved portion 62-1 is formed by curving the slide member 62. For this reason, the pair of first curved portions 41-1 and 42-1 and the second curved portion 62-1 can be formed with a larger curvature than the rod and rod holder coupling the abdomen rest member and shoulder rest member in a convention musical instrument carrier. That is, both curved surfaces having a convex part and a concave part of the second curved portion 62-1 and the respectively opposing surfaces of the pair of first curved portions 41-1 and 42-1 make surface contact with a large curvature in the manner of being sandwiched.

Thereby, it is possible to support the abdomen rest member 11 with respect to the shoulder rest member 18 by surface contact of a large curvature. That is, the surface area over which the slide member 62 and the coupling member 16 make contact increases, whereby the holding force becomes greater. Accordingly, since it becomes easier to maintain the state of the musical instrument carrier 10, in particular the abdomen rest member 11 thereof, being in close contact with the body of the performer, it is possible to inhibit shifting of the musical instrument carrier 10 from the body of the performer during a performance.

Also, since the pair of first curved portions 41-1 and 42-1 and the second curved portion 62-1 have a circular arc shape, by sliding the slide member 62 with respect to the coupling member 16 along the curvature direction in the shape of the arc, it is possible to continuously change the attachment angle of the abdomen rest member 11 with respect to the shoulder rest member 18.

Figure 7:
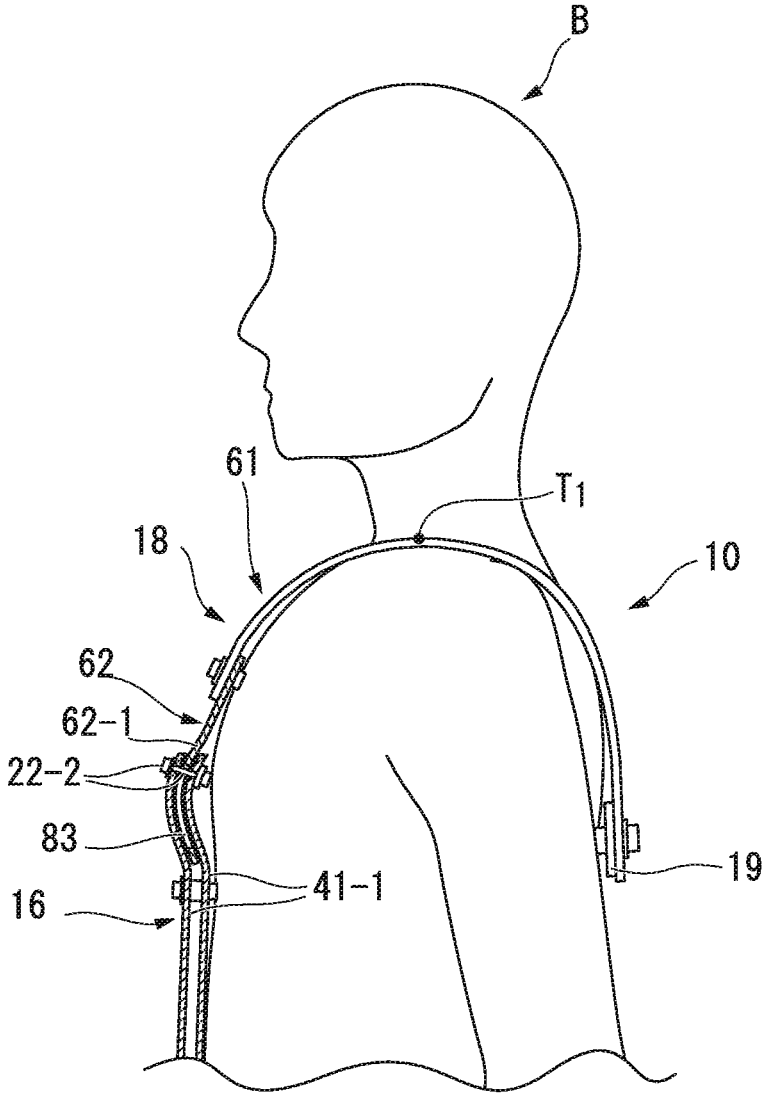
FIG. 7 is a side view showing the state of a performer with a thin physique wearing the musical instrument carrier of the present embodiment.
Figure 8:
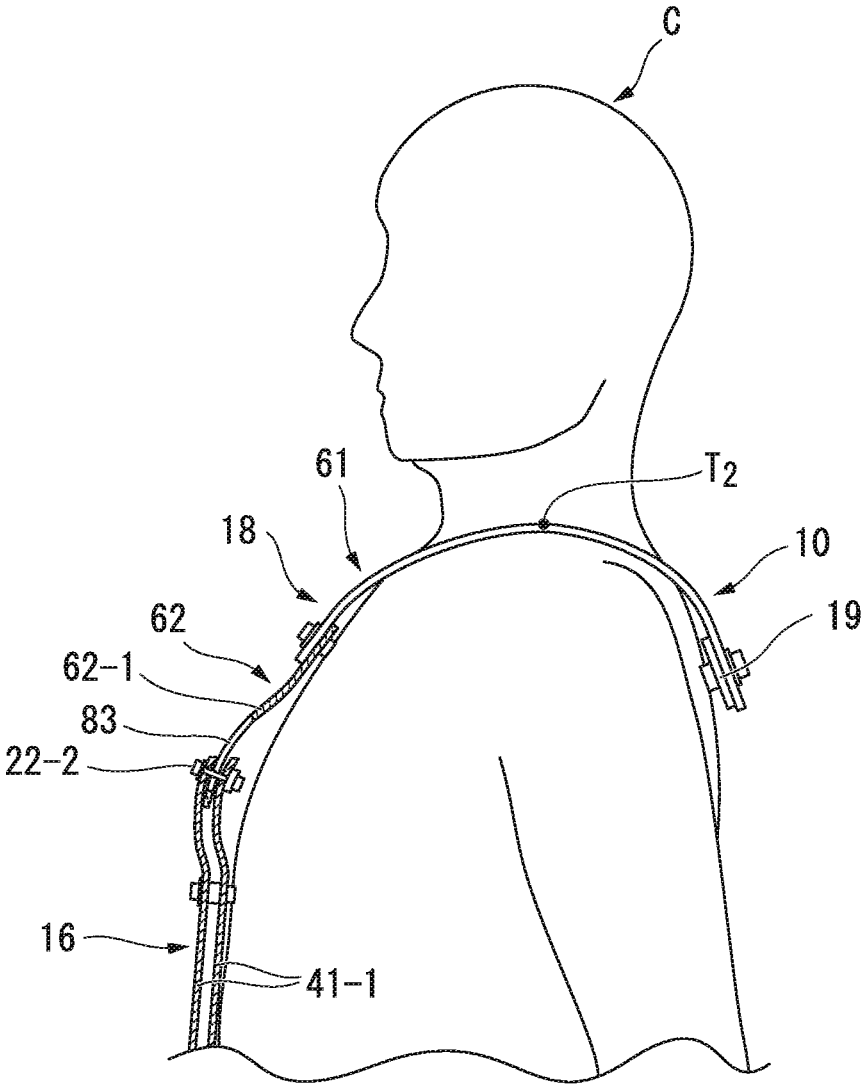
FIG. 8 is a side view showing the state of a performer with a heavy physique wearing the musical instrument carrier of the present embodiment.

FIG. 7 is a side view that schematically shows the state of a performer with a thin physique wearing the musical instrument carrier shown in FIG. 4. FIG. 8 is a side view that schematically shows the state of a performer with a heavy physique wearing the musical instrument carrier shown in FIG. 4.

In FIG. 7 and FIG. 8, the same reference numerals are given to those constituent portions that are the same as the corresponding structures shown in FIG. 1 to FIG. 6. Also, in FIG. 7 and FIG. 8, for the sake of convenience of description, the pair of first curved portions 41-1 and 42-1 and the second curved portion 62-1 are illustrated in cross section.

Here, the manner in which the second curved portion 62-1 slides between the curved portions 41-1 and 42-1 in accordance with the physique of the performer, and whether the musical instrument carrier is mounted on the performer will be described.

When a performer B with a thin physique (a physique with a small abdominal thickness) wears the musical instrument carrier 10, since the performer B's body is thin, the second curved portion 62-1 slides downward along the pair of first curved portions 41-1 and 42-1. Thereby, the top point $T_1$ of the shoulder rest member 18 is disposed at a position near the coupling member 16. At such a position, a state arises in which the contact surface area of the shoulders of the performer B and the shoulder rest member 18 is large.

When a performer C with a heavy physique (a physique with a large abdominal thickness) wears the musical instrument carrier 10, since the performer C's body is thick, the second curved portion 62-1 slides upward along the curved surfaces of the pair of first curved portions 41-1 and 42-1, and the top point $T_2$ of the shoulder rest member 18 is formed at a position far from the coupling member 16 (a position farther than the top point $T_1$ shown in FIG. 7).

At such a position, a state arises in which the contact surface area of the shoulders of the performer C and the shoulder rest member 18 is large.

As described above, by the sliding of the second curved portion 62-1 along the curved surfaces of the pair of first curved portions 41-1 and 42-1, it is possible to change the angle and top-point position of the shoulder rest member 18. Thereby, it is possible to increase the contact surface area between the shoulders of performers of various physiques and the shoulder rest member 18.

Note that although not illustrated, a cushion member that protects the abdominal portion, chest portion, or shoulders of the performer may as needed be provided on the back surface 31*b* of the abdomen rest member main body 31, the surface of the coupling member 16 (back surface of the plate member 42) that comes into contact with the chest of the performer, and the lower surface of the shoulder rest member 18 that comes into contact with the shoulders of the performer.

Thereby, even in the case of using the musical instrument carrier 10 to support a heavy musical instrument, it is possible to prevent regions of the performer's body that come into contact with the musical instrument carrier 10 from becoming sore.

The back rest member 19 is a band-shaped member for coupling the other end portions of the pair of shoulder rest member main bodies 61.

Both ends of the back rest member 19 are coupled to the other end portions of the pair of shoulder rest member main bodies 61 by the washer plates 26, the bolts 27, and the nut plates 28. The back rest member 19 is a member that is abutted on the back of the performer.

Figure 9:
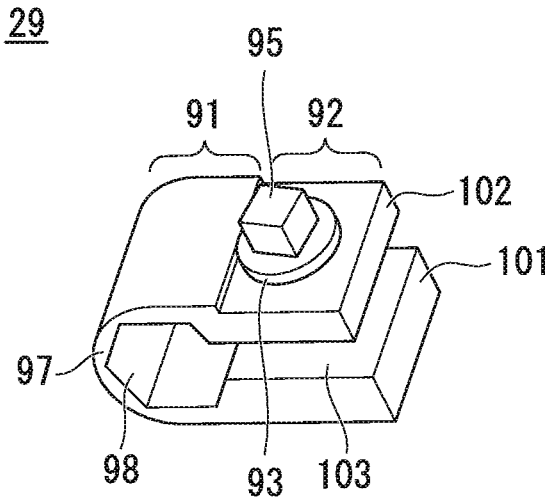
FIG. 9 is a perspective view showing the rod position regulating member shown in FIG. 1.
Figure 10:
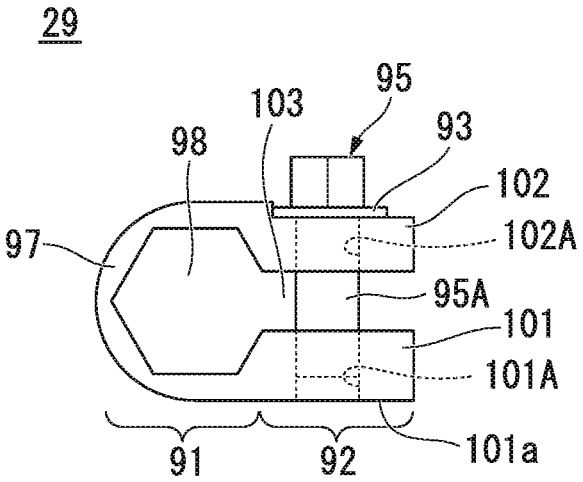
FIG. 10 is a side view showing the rod position regulating member shown in FIG. 1.

FIG. 9 is a perspective view of the rod position regulating member shown in FIG. 1. FIG. 10 is a side view showing the rod position regulating member shown in FIG. 9. In FIG. 9 and FIG. 10, the same reference numerals are given to the constituent portions that are the same as the corresponding portions shown in FIG. 1 and FIG. 2.

The rod position regulating member 29 is a constitution that fastens both end sides of a U-shaped member, and has a rod mounting portion 91, a protruding portion 92, a nut plate 93, and a bolt 95.

The rod mounting portion 91 has a rod mounting portion main body 97 and a rod insertion through hole 98. In the loosened state of the bolt 95, the rod mounting portion 91 allows both rotation and sliding of the rod 14.

The rod mounting portion 91 rotates with respect to the rod 14, whereby even if the rod 14 is in a state of being affixed to the rod clamp 12, it is possible to cause the protruding portion 92 of the rod position regulating member 29 to come into contact with or move away from the front surface 31*a* of the abdomen rest member main body 31. Also, the rod mounting portion 91 slides with respect to the rod 14, whereby it is possible to cause the end face of the rod position regulating member 29 to abut or move away from the rod clamp 12.

The shape of the rod mounting portion 91 positioned on the side opposite the side at which the protruding portion 92 is disposed can for example be semicircular.

The rod insertion through hole 98 is a through hole that is provided so as to penetrate the rod mounting portion main body 97. The shape of the rod insertion through hole 98 when observed from the side surface can for example be hexagonal or circular, but is not limited thereto.

Note that in FIG. 9 and FIG. 10, as one example of the shape of the rod insertion through hole 98 when observed from the side surface, a hexagonal shape is illustrated.

In the state of the rod mounting portion 91 being mounted on the rod 14, the protruding portion 92 protrudes in a direction intersecting the center axis L of the rod 14 (in the case of the present embodiment, a direction perpendicular with the center axis L as one example).

Note that in the present embodiment, a description is given taking as an example the protruding portion 92 protruding in a direction perpendicular with the center axis L, but it is not necessarily always perpendicular, and the protruding portion may protrude in a direction that intersects the center axis L.

The protruding portion 92 has a first plate portion 101, a second plate portion 102, and a space 103.

The first plate portion 101 is integrally constituted with one end portion of the rod mounting portion 91 that is positioned on the front surface 31*a* side of the abdomen rest member main body 31. The first plate portion 101 has a screw hole 101A that penetrates the center thereof.

The second plate portion 102 is integrally constituted with the other end portion of the rod mounting portion 91. The second plate portion 102 is disposed opposing the first plate portion 101 via the space 103.

The second plate portion 102 has a screw hole 102A that penetrates the center thereof and is disposed opposite the screw hole 101A.

The space 103 is a plate-shaped space, and is connected with the rod insertion through hole 98.

That is, the structure which consists of the rod mounting portion 91 and the protruding portion 92 is made into a U shape.

It is preferable to constitute the rod mounting portion 91 and the protruding portion 92 with a material such that for example the protruding portion 92 deforms to a degree when the bolt 95 is screwed in. As such a material, it is possible to use for example aluminum.

The bolt 95 is screwed into the screw holes 102A and 101A from the second plate portion 102 side via the nut plate 93.

When the bolt 95 is tightened in the state of the rod 14 inserted in the rod insertion through hole 98, since the width of the space 103 narrows in the extension direction of the shaft portion 95A of the bolt 95 and the diameter of the rod insertion through hole 98 narrows, the rod position regulating member 29 is fixed to the rod 14.

Conversely, when the bolt 95 of the rod position regulating member 29 fixed to the rod 14 is loosened, since the width of the space 103 widens in the extension direction of the shaft portion 95A of the bolt 95 and the diameter of the rod insertion through hole 98 increases, it is possible to change the orientation of the rod position regulating member 29 with respect to the abdomen rest member 11 by rotating it with respect to the rod 14, and it is possible to remove the rod position regulating member 29 by sliding it along the rod 14.

The length of the shaft portion 95A of the bolt 95 may be made a length that does not protrude to the abdomen rest member main body 31 side in the state of for example a rod being fixed to the rod mounting portion 91 by tightening the bolt 95.

Thereby, when regulating the height of the rod 14 and/or the rotation of the rod 14 using the rod position regulating member 29, or when loosening the bolt 95, the abdomen rest member main body 31 is not damaged by the distal end of the shaft portion 95A, and it is possible to abut the surface 101*a* of the first plate portion 101 disposed on the abdomen rest member main body 31 side on the front surface 31*a* of the abdomen rest member main body 31.

Next, the method of using the musical instrument carrier that employs the rod position regulating member 29 will be described, focusing on the operation of the rod 14 and the rod position regulating member 29 accompanying the use thereof. Here, as an example the description shall be given of once converting the musical instrument carrier 10 shown in FIG. 1 and FIG. 2 from a state of being used as a musical instrument carrier to the storage state when not used, and then returning it to the usage state.

The state of using the musical instrument carrier 10 as a musical instrument carrier is the state shown in FIG. 1 and FIG. 2. In this state, each of the rods 14 is fixed to the abdomen rest member 11 by the tightening of the bolt 39 so as to assume a position of an angle and a height capable of supporting a musical instrument, in the state of the short straight bar portion 14-2 and the sloping coupling portion 14-3 of each rod 14 being in a predetermined opened state at the front side.

At this time, the rod position regulating member 29 regulates the height of the rod in the state of the face thereof that opposes the rod clamp 12 abutting on the rod clamp 12, and the protruding portion 92 regulates the spacing between the short straight bar portions 14-2 of the rods 14 (that is, the opening degree of the rods 14) in the state of abutting on the abdomen rest member.

The carrier can be converted from the use state to a storage state. In the storage state, the moving components are folded so as to make the musical instrument carrier 10 as compact as possible.

By collapsing each rod 14 so that the short straight bar portion 14-2 and the sloping coupling portion 14-3 mutually overlap at the center of the abdomen rest member, the rods 14 are made to conform as much as possible to the flat surface of the abdomen rest member 11 and thereby made compact in the depth direction. Moreover, by the rod clamp 12 clamping the long straight bar portion 14-1 of the rod 14 at the lowest possible position (the position near the sloping coupling portion 14-3) so that the sloping coupling portion 14-3 approaches the abdomen rest member as much as possible, the rod 14 is made compact in the height direction.

When converting the carrier from the state of use to the storage state, first, the two bolts 39 are loosened to put the pair of rods 14 inserted in the pair of rod clamps 12 into a movable state in the vertical position and rotation direction.

At this time, the bolt 95 is left tightened and so the state of the rod position regulating member 29 being fixed to the rod 14 is maintained.

Next, the rods 14 that have become movable are rotated and collapsed so that the short straight bar portion 14-2 and the sloping coupling portions 14-3 mutually overlap at the center of the abdomen rest member 11, and are slid along the long straight bar portions 14-1 so that the sloping coupling portions 14-3 approach the abdomen rest member 11 as much as possible. In the state of having collapsed the rods 14 and slidden them up to make them as compact as possible, the two bolts 39 are tightened. Then, in the state of other movable components made as compact as possible, the carrier is put in the storage state.

At this time, the rod position regulating member 29 assumes a state of the face thereof opposite the rod clamp 12 being separated from the rod clamp 12, and the protruding portion 92 assumes a state of separation from the abdomen rest member 11. In this storage state, storage is possible even without the rod position regulating member 29 performing its regulating function.

Moreover, the musical instrument carrier 10 is returned from the storage state to the state once again of being used as musical instrument carrier supporting a musical instrument (the state shown in FIG. 1 and FIG. 2).

In the musical instrument carrier 10 put in the aforedescribed storage state, each rod 14 while in the collapsed state is slidden along the long straight bar portion 14-1 so that the sloping coupling portion 14-3 is moved away from the abdomen rest member 11.

At this time, by sliding the rod 14 until the rod position regulating member 29 enters a state of the face thereof opposite the rod clamp 12 abutting the rod clamp 12, it is possible to easily return the rod 14 to its position in the height position prior to storage. The rod 14 is then raised so that the short straight bar portion 14-2 may come forward.

At this time, the protruding portion 92 of the rod position regulating member 29 rotates until meeting the abdomen rest member 11, whereby it is possible to easily return the rods 14 to the opening degree of the short straight bar portions 14-2 prior to storage.

Also, due to the affixed rod position regulating member 29 making contact with the rod clamp 12 and stopping, the pair of rods 14 can be prevented from separating from the rod clamps 12 and falling, and the positions of the rods 14 in the height direction are regulated. By putting the other moving parts in the state enabling use as a carrier, it is possible to return the musical instrument carrier 10 to the state of being used as a musical instrument carrier.

In this way, according to the musical instrument carrier of the present embodiment, it is possible to easily switch between the storage state and the use state.

Note that in the case of making the clamp position of the rod 14 with respect to the abdomen rest member 11 lower than the original position where the rod position regulating member 29 is clamped (in other words, making the length of the portion of the rod 14 that extends below the rod clamp 12 longer than the length of the rod 14 shown in FIG. 1 and FIG. 2), the bolt 95 is loosened prior to loosening the bolt 39, and after sliding the rod position regulating member 29 upward, the bolt 95 is tightened to set and affix the rod position regulating member 29 at the new position on the rod 14, and afterward the bolt 39 should be loosened to affix the rod 14 at the new position.

By following this procedure, since the position can be adjusted in a state in which either one of the bolt 39 and the bolt 95 is always tightened, it is possible to prevent the pair of rods 14 from falling from the rod clamps 12 even when the lengths of the pair of rods 14 are being increased.

In this way, the rod position regulating member 29 is arranged so as to make contact with the rod clamp 12, and then by affixing the rod position regulating member 29 to the rod 14, since the position of the rod clamp 12 affixed to the abdomen rest member 11 can be made to serve as a reference position in the height direction, it is possible to easily reproduce the position-adjusted height of the rods 14.

In the case of regulating only the height direction of the pair of rods 14 using the rod position regulating member 29, after bringing the lower end of the rod position regulating member 29 and the upper end of the rod clamp 12 into contact, the rod position regulating member 29 is affixed to the pair of rods 14 so that the rod position regulating member 29 and the front surface 31*a* of the abdomen rest member main body 31 do not make contact.

In this way, after position adjustment of the rods 14, by bringing the rod position regulating member 29 into contact with the rod clamp 12 and affixing the rod position regulating member 29 to the rod 14, even if the pair of rods 14 move to the center side or above the abdomen rest member main body 31, by bringing the rod clamp 12 and the rod position regulating member 29 into contact, it is possible to easily make the height of the pair of rods 14 the position-adjusted height.

Note that in this case, adjustment of the position of the pair of rods 14 in the rotation direction is performed at the stage of inserting each rod 14 in the rod insertion hole of the rod mounting mechanism.

In the case of regulating the height and rotation-direction position of the pair of rods 14 using the rod position regulating member 29, the lower end of the rod position regulating member 29 and the upper end of the rod clamp 12 are brought into contact, and in the state of the first plate portion 101 being made to abut the front surface 31*a* of the abdomen rest member main body 31, the rod position regulating member 29 is affixed to each of the pair of rods 14.

In this way, by bringing the rod position regulating member 29 and the upper end of the rod clamp 12 into contact and affixing the rod position regulating member 29 to each of the pair of rods 14 in the state of the first plate portion 101 being made to abut the front surface 31*a* of the abdomen rest member main body 31, even in the case of the pair of rods 14 being moved to the center side or above the abdomen rest member main body 31, by bringing the rod clamp 12 and the rod position regulating member 29 into contact and causing the first plate portion 101 to abut the front surface 31*a* of the abdomen rest member main body 31, it is possible to easily make the height and rotation-direction position of the pair of rods 14 the position-adjusted height and rotation-direction position of the pair of rods 14.

Next, by inserting the short straight bar portion 14-2 of each rod, to which is affixed the rod position regulating member 29, into the rod insertion hole of a rod mounting mechanism mounted to another musical instrument, the musical instrument carrier 10 supports another musical instrument via the rod mounting mechanism.

After a performance of the other musical instrument, when storing the musical instrument carrier 10 in a storage room or the like, the musical instrument carrier 10 is stored in the state of the rod position regulating member 29 being affixed to each of the pair of rods 14.

At this time, by rotating the pair of rods 14 to the side where the protruding portion 92 is not present, it is possible to put the rods 14 in a closed state. Thereby, it is possible to reduce the space required for storage of the musical instrument carrier 10.

Also, when using the rod position regulating member 29 after the carrier is stored in the state of the rod position regulating member 29 being affixed to each rod 14, it is possible to easily make the height and the rotation-direction position of the rods 14 the position-adjusted height and rotation-direction position of the pair of rods 14.

Also, when performing a musical instrument using the position adjustment after storage, by using the procedure described above, it is possible to easily insert the pair of rods 14 into the rod insertion holes of the rod mounting mechanism.

Note that in the example of the method of using the rod position regulating member 29 described above, the case of affixing the rod position regulating member 29 to the rod 14 so that the protruding portion 92 is positioned on the outer side was taken as an example, but the pair of rod position regulating members 29 may be respectively affixed to the rods 14 so that the protruding portions 92 are disposed on the inner side.

In this case, when storing the musical instrument carrier, in the state of the short straight bar portion 14-2 and the sloping coupling portion 14-3 of each rod 14 being rotated to the outer side, the musical instrument carrier is stored. The musical instrument carrier that is constituted in this manner can obtain the same effects as the case of the protruding portion 92 being disposed on the outer side.

Also, a pair of the rod position regulating members 29 may be affixed to upper and lower positions of one rod 14 in a manner sandwiching the rod clamp 12. In this case, after adjusting the positions of the rods 14 so as to be able to use a musical instrument, in the state of one end face of each of the pair of rod position regulating members 29 abutting the rod clamp and the protruding portion 92 abutting the abdomen rest member, the bolt 95 is tightened and fixed, and then after adjusting the positions of the pair of rods 14 so as to enable insertion in the rod insertion holes of the rod mounting mechanisms mounted on another instrument, in the state of the other end face of each of the pair of rod position regulating members 29 being abutted on the rod clamp and the protruding portion 92 being abutted on the abdomen rest member, the bolt 95 is tightened and fixed.

At this time, the protruding portions 92 constituting the pair of rod position regulating members 29 disposed below the rod clamps 12 are arranged to be positioned on the opposite side of the protruding portions 92 constituting the pair of rod position regulating members 29 disposed above the rod clamps 12.

In this way, by affixing a pair of the rod position regulating members 29 to the rods 14 above and below the rod clamps 12 in accordance with different musical instruments, it is possible to reproduce the positions on the rods 14 for two musical instruments by the upper and lower rod position regulating members 29.

As the rod position regulating member 29, a fastening member that is detachable from the rod 14 should be used.

By using a fastening member that is detachable from the rod 14 as the rod position regulating member 29 (as one example, the structure shown in FIG. 9 and FIG. 10), it is possible to easily attach and detach the rod position regulating member 29 to/from the rod 14.

Note that the fastening member shown in FIG. 9 and FIG. 10 is only one example, and the structure of the rod position regulating member 29 is not limited to the structure shown in FIG. 9 and FIG. 10.

According to the musical instrument carrier 10 of the present embodiment, by including the rod position regulating member 29, after the positions of the rods 14 for mounting on a musical instrument (after adjustment of the height of the rods 14 and/or the position of the rods 14 in the rotation direction) have been determined, it is possible to affix the rod position regulating members 29 to the positioned rods 14 so as to make contact with the rod clamps 12.

Thereby, in the state of for example the rod position regulating member 29 being affixed to each rod 14, even if the height of the rods 14 and/or the position of the rods 14 in the rotation direction are/is altered from the position that has been determined, it is possible to easily reproduce the height of the rod 14 and/or the predetermined position of the rod 14 in the rotation direction.

Note that in the present embodiment, as one example, a description was given citing the case of providing the pair of first curved portions 41-1 and 42-1 and the second curved portion 62-1 at the portion abutted on the chest of the performer, but the arrangement position of the pair of first curved portions 41-1 and 42-1 and the second curved portion 62-1 is not limited thereto.

The pair of first curved portions 41-1 and 42-1 and the second curved portion 62-1 for example may also be arranged at the abdomen rest member 18, and may be arranged at the shoulder rest member main bodies 61. It is possible to obtain the same effect as the present embodiment in such cases as well.

Also, instead of the constitution of the pair of first curved portions 41-1 and 42-1 and the second curved portion 62-1, one may be adopted that can adjust the angle of the shoulder rest member and the abdomen rest member by fastening and fixing support rods in the manner shown in the aforementioned JP-A 2003-5754.

In this case, by attaching the rod position regulating members 29 to the support rods and having the protruding portions thereof abut on the shoulder rest member, it may be used to regulate the angle of the shoulder rest member and the abdomen rest member.

For example, the width of the rod holders 87 and 88 in FIG. 10 of the aforementioned JP-A 2003-5745 may be made narrower than the shoulder straps 76 and 77, and the rod position regulating members 29 may be affixed to the empty area, whereby when the support rods are rotated, the protruding portions may be made to abut on the shoulder straps 76 and 77.

Also, if the distance (height) between the shoulder rest member and the abdomen rest member is adjusted by rods, the rod position regulating member may be used as a position regulating member of the rods. Without being limited thereto, it is also possible to use the rod position regulating member of the present invention in musical instrument carriers having constitutions in which rods are employed for operation.

Also, in the present embodiment, as one example, a description was given citing the case of using the shoulder rest member 18 in which the shoulder rest member main bodies 61 and the slide member 62 are separate units, but a shoulder rest member may be used in which the shoulder rest member main bodies 61 and the slide member 62 are integrated.

The size of the pair of first curved portions 41-1 and 42-1 and the second curved portion 62-1 (for example, the magnitude of the curvature radius of the curvature and the angle of the arc) and the extent of the curvature are not limited to the pair of first curved portions 41-1 and 42-1 and the second curved portion 62-1 shown in FIG. 4 and FIG. 5.

By changing the size of the pair of first curved portions 41-1 and 42-1 and the second curved portion 62-1 (for example, the magnitude of the radius) and the extent of the curvature, it is possible to change the magnitude of the radius and the top-point position of the shoulder rest member 18. Thereby, application to more performers with differing body shapes becomes possible.

For example, slide members of a plurality of types with differing radius magnitudes and differing top-point positions, and coupling members including a pair of first curved portions corresponding thereto are respectively prepared, and by using the slide members and coupling members in accordance with the physique of the performer, it is possible to apply the musical instrument carrier to more performers with differing body types.

Also, in the present embodiment as one example, a description was given taking as an example the musical instrument carrier 10 not having a hip rest member coupled to the back rest member 19 and abutting the hips of the performer, but the present invention can be applied to a musical instrument carrier having a hip rest member.

Also, in the present embodiment, a description was given taking as an example the case of the slide member 62 having three slide grooves (specifically, slide grooves 82 to 84), but in the case of forming the slide grooves in the slide member 62, the number thereof may also be one and is not limited to three.

In the case of for example the bulging of the bolts 22-1, 22-2, and 22-3 being a concern, the head portions of the bolts 22-1, 22-2, and 22-3 may be covered with resin having a hemispherical shape.

Thereby, catching and localized rubbing of the head portions of the bolts 22-1, 22-2, and 22-3 directly on a costume are eliminated, and it is possible to inhibit to a greater degree damage to a costume.

Also, in the present embodiment, bolts and nuts (including the nut plates and screw holes with threads cut in members) were used as the fastening members, but for example a cam lever lock system may be adopted instead of a nut and bolt, and fastening may also be achieved by other members and constitutions.

Figure 11:
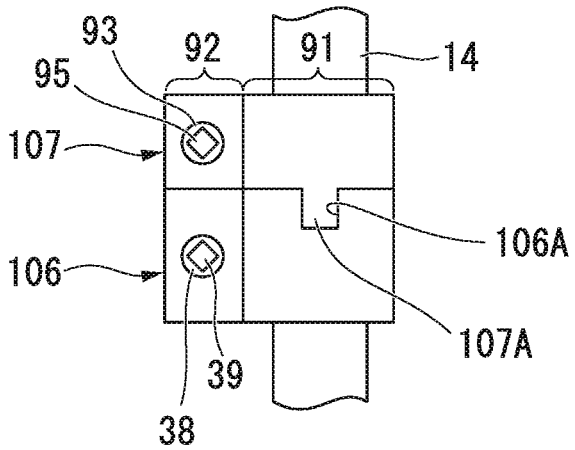
FIG. 11 is a plan view showing a first modification of the rod position regulating member and rod clamp in the present embodiment.

FIG. 11 is a plan view showing the rod position regulating member and rod clamp according to a first modification in the present embodiment. In FIG. 11, the same reference numerals are given to those constituent portions that are the same as the corresponding structures shown in FIGS. 2, 9, and 10.

A rod clamp 106 has the same constitution as the rod clamp 12 described above, other than having a concavity 106A.

A rod position regulating member 107 has the same constitution as the rod position regulating member 29 described above, other than having a convexity 107A corresponding to the shape of the concavity 106A and being capable of being inserted in the concavity 106A.

In the case of using the rod clamp 106 and the rod position regulating member 107 constituted in this way, after adjusting the position of the rod 14, the convexity 107A is inserted in and engaged with the concavity 106A, and by affixing the rod position regulating member 107 to the rod 14 in the state of the rod clamp 106 and the rod position regulating member 107 abutting, it is possible to reproduce the position-adjusted position of the rod 14 in the rotation direction thereof.

Figure 12:
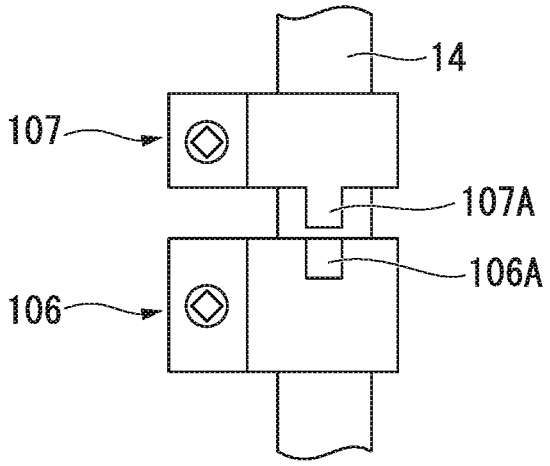
FIG. 12 is a plan view showing another method of using the rod position regulating member and rod clamp shown in FIG. 11.

FIG. 12 is a plan view for describing another method of using the rod position regulating member and rod clamp shown in FIG. 11. In FIG. 12, the same reference numerals are given to those constituent portions that are the same as the corresponding structures shown in FIG. 11.

The concavity 106A and the convexity 107A may also be made to face each other, and then the convexity 107A may be brought near and arranged on the concavity 106A. In this case, it is possible to reproduce the position-adjusted height of the rod 14 and the position of the rod 14 in the rotation direction.

Figure 13:
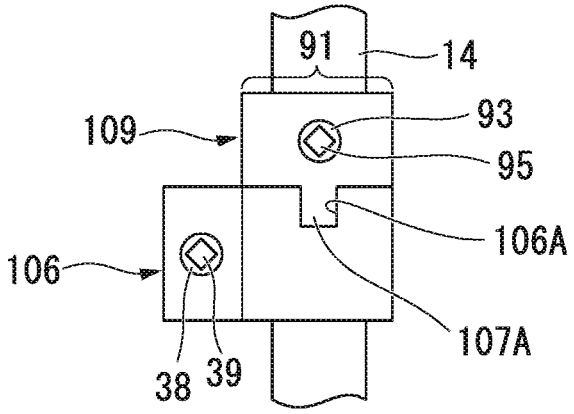
FIG. 13 is plan view showing a second modification of the rod position regulating member in the present embodiment.

FIG. 13 is a plan view showing the rod position regulating member according to the second modification of the present embodiment.

In FIG. 13, the same reference numerals are given to those constituent portions that are the same as the corresponding structures shown in FIG. 2, FIG. 9, FIG. 10, and FIG. 11. Also, in FIG. 13, the rod clamp 106 shown in FIG. 11 is illustrated.

The rod position regulating member 109 is constituted identically to the rod position regulating member 107, except for excluding the protruding portion 92 from the rod position regulating member 107 shown in FIG. 11 and fastening the rod mounting portion 91 to the rod 14 using the nut plate 93 and the bolt 95.

In the case of using the rod position regulating member 109 in place of the rod position regulating member 107 shown in FIG. 11 described above, after adjusting the position of the rod 14, in the state of the convexity 107A is inserted in and engaged with the concavity 106A, by affixing the rod position regulating member 109 in the rod 14, it is possible to reproduce the position-adjusted position of the rod in the rotation direction.

Note that the convexity 107A of the rod position regulating member 109 and the concavity 106A of the rod clamp 106 may also be made to face each other, and then the convexity 107A may be brought near and arranged on the concavity 106A.

In addition, the case of there being one concavity 106A was taken as an example in the above description, but a constitution is also possible that provides a plurality of the concavities 106A in the circumferential direction of the rod 14, and by selectively engaging from among them with the convexity 107A, performs regulation with a plurality of desired positions.

Note that the protruding portion 92 and a member that makes contact therewith in the present invention include the concavity 106A and the convexity 107A shown in FIG. 11 to FIG. 13. That is, they should be portions that are displaced in the rotation direction of the rod during rotation thereof, and should abut displacement members that are relatively displaced with respect to the rod 14 at a predetermined rotation position of the rod 14 (for example, the abdomen rest member 11 and the rod clamp 12 and the like).

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A musical instrument carrier comprising:

a carrier main body portion;

a rod that supports a musical instrument at the front surface of the carrier main body portion;

a rod clamp that is attached to the front surface of the carrier main body portion and that selectively holds the rod in either one of a movable state in the lengthwise direction of the rod or a fixed state in the lengthwise direction; and a rod position regulating member that is attached to the rod and that selectively engages with the rod in either one of a movable state in the lengthwise direction or a fixed state, the rod position regulating member being located at a position above a position of the rod clamp.

2. The musical instrument carrier according to claim 1, wherein the attachment position of the musical instrument is set by causing the rod clamp to hold the rod in a movable state in the lengthwise direction in the state of the rod position regulating member being affixed to a predetermined position of the rod in the lengthwise direction, thereby enabling the rod position regulating member to move in the lengthwise direction of the rod and to rotate about the lengthwise direction within a prescribed range, abutting the rod position regulating member on the rod clamp or the carrier main body portion, and causing the rod clamp to hold the rod in a fixed state in the lengthwise direction, thereby positioning the rod with respect to the carrier main body portion.

3. The musical instrument carrier according to claim 1, wherein the carrier main body portion has an abdomen rest member that is abutted on the abdomen of a performer, and the rod clamp is affixed to the front surface of the abdomen rest member.

4. The musical instrument carrier according to claim 1, wherein the rod clamp has a first fastening member that selectively holds the rod in either one of the movable state or the fixed state, and the first fastening member, when loosened, holds the rod in the movable state, while the first fastening member, when tightened, holds the rod in the fixed state.

5. The musical instrument carrier according to claim 1, wherein the rod position regulating member positions the rod by abutting the rod clamp in the state of being affixed to the rod.

6. The musical instrument carrier according to claim 1, wherein the rod position regulating member is detachable from the rod.

7. The musical instrument carrier according to claim 6, wherein the rod position regulating member has a second fastening member, and the second fastening member, when tightened, engages with the rod in a fixed state, while the second fastening member, when loosened, movably engages with the rod.

8. A musical instrument carrier comprising:

a carrier main body portion;

a rod that supports a musical instrument at the front surface of the carrier main body portion;

a rod clamp that is attached to the front surface of the carrier main body portion and that selectively holds the rod in either one of a movable state in the lengthwise direction of the rod or a fixed state in the lengthwise direction; and a rod position regulating member that is attached to the rod and that selectively engages with the rod in either one of a movable state in the lengthwise direction or a fixed state, wherein:

the rod clamp holds the rod to rotate about the lengthwise direction, and the carrier main body portion or the rod clamp, as a displacement member, is displaced relative to rotation of the rod when the rod is rotated about the lengthwise direction, and the musical instrument carrier further comprising a protruding portion provided in either one of the displacement member and the rod position regulating member to regulate rotation of the rod.

9. The musical instrument carrier according to claim 8, wherein the protruding portion prevents the rod from rotating by abutting on the other member in which the protruding portion is not provided among the displacement member and the rod position regulating member during rotation of the rod.

10. The musical instrument carrier according to claim 8, wherein the rod position regulating member is rotatable in a range of not abutting on the displacement member during rotation of the rod.

11. The musical instrument carrier according to claim 8, wherein the displacement member is the abdomen rest member included in the carrier main body portion or the rod clamp.

* * * * *